US005336866A

United States Patent [19]

Winstead et al.

[11] Patent Number: 5,336,866

[45] Date of Patent: Aug. 9, 1994

[54] FABRIC SAMPLE TREATMENT APPARATUS

[75] Inventors: Charles D. Winstead, Pacolet Mills; Ralph A. Cantrell, Chesnee, both of S.C.

[73] Assignee: Milliken Research Corporation, Spartanburg, S.C.

[21] Appl. No.: 122,884

[22] Filed: Sep. 16, 1993

[51] Int. Cl.[5] ..... F27B 9/06; F27D 3/12

[52] U.S. Cl. ..... 219/411; 219/388; 392/416; 392/418

[58] Field of Search ..... 219/400, 405, 411, 388; 392/416, 418; 374/133, 149, 153-155

[56] References Cited

U.S. PATENT DOCUMENTS

| | | | |
|---|---|---|---|
| 3,295,434 | 1/1967 | Wilhelm | 219/388 |
| 3,305,000 | 2/1967 | Bullen | 219/388 |
| 3,333,476 | 8/1967 | Hardy | 374/155 |
| 3,651,405 | 3/1972 | Whitney | 374/155 |
| 4,079,104 | 3/1978 | Dickson | 219/388 |
| 4,333,003 | 6/1982 | Rivera | 392/418 |
| 4,484,064 | 11/1984 | Murray | 219/400 |
| 4,680,450 | 7/1987 | Thorson | 219/388 |

*Primary Examiner*—Teresa J. Walberg
*Attorney, Agent, or Firm*—Terry T. Moyer; James M. Robertson

[57] ABSTRACT

A fabric sample treatment apparatus for effecting the controlled and uniform heating of a plurality of fabric and dye liquor specimens. The treatment apparatus includes a heating chamber having a rotatable sample rack, a radiant heat source, multidirectional cooling air vents, temperature measurement devices for monitoring chamber and specimen temperature and control equipment for controlling radiant heat and cooling air based on temperature measurements.

6 Claims, 6 Drawing Sheets

FABRIC SAMPLE TREATMENT APPARATUS

FIELD OF THE INVENTION

The present invention relates generally to fabric sample treatment equipment and more particularly to equipment for carrying out dye testing and evaluations of color fastness subsequent to dying.

BACKGROUND OF THE INVENTION

In preparing fabric material for industrial and consumer use it is often desirable to be able dye samples of the material on a laboratory scale. For example, laboratory scale dye tests are often useful for generating samples of material for selection by a purchaser prior to the placing of an order, thereby ensuring that both the purchaser and the seller are in full agreement with regard to the coloration of the fabric to be purchased. Laboratory scale dying is also of benefit in evaluating the performance of various dyes when applied to fabrics under production conditions thus permitting the entity performing the dyeing operation to select those dyes which will perform best.

As will be recognized, in order to derive meaningful comparative data, the dye testing as described above must be carried out on multiple fabric samples dyed under substantially similar test conditions. Moreover, in order to be useful, these test conditions must closely resemble actual production dying operations. It will be readily appreciated that in carrying out these evaluations, it is desirable to minimize any variability regarding the treatment of individual samples which may tend to reduce the confidence level for the tests.

It has long been recognized that the simultaneous treatment of a relatively large number of samples in a single test unit permits researchers to minimize the variability associated with multiple individual tests. However, in order for a meaningful comparative analysis of the samples to be made, each of the samples within the apparatus must, in fact, be subjected to substantially the same conditions during the test.

Since many commercial dying operations are performed at elevated controlled temperatures of between 200 and 300 degrees Fahrenheit, it is necessary to carry out dye testing in a similar environment. Accordingly, a testing apparatus is required which is capable of simultaneously subjecting multiple dye test specimens to elevated and controlled temperatures.

Prior to the present invention, the need to uniformly subject multiple samples to a high temperature environment was met primarily by enclosing fabric specimens and dye liquor within liquid tight sample containers and thereafter passing these containers through a heated bath of relatively high boiling point liquid such as, for example, a glycerin emulsion. These systems typically utilize a bath chamber which houses a rotatable sample rack capable of holding approximately twenty (20) individual sample containers. This sample rack is rotated within the bath chamber so as to intermittently pass each of the sample containers through the heated liquid bath. The bath temperature is controlled by means of several stainless steel electric immersion heaters in combination with a tap water cooling coil. The operation of the immersion heaters and tap water cooling coil is in turn controlled by a programmable logic controller based on temperature readings taken within the bath.

In operation, as each of the sample containers is passed through the heated bath, the temperature of the dye liquor and fabric sample housed within the container tends to equilibrate with the temperature of the bath. Thus, the temperature of the samples may be driven upwards to a level approximating that of production dying operations. Moreover, the rotating action provides contacting agitation between the dye liquor and the sample, thereby simulating the mechanical action of a production dyeing operation.

As will be recognized, while the use of a heated bath may provide a uniform temperature environment for all samples, a number of problems are also associated with such a process. For example, the potential for corrosion is significant in such liquid processes thereby necessitating the initial use of high cost corrosion resistant materials for construction. Further, during the life of the equipment, corrosion damage which does occur may give rise to costly and time consuming repair or replacement of the damaged portions.

In an attempt to eliminate some of the undesirable aspects of liquid bath equipment, there has been some effort in the industry to replace the heated liquid bath with radiant heating elements. One such heating device incorporates the use of a vertically oriented rotatable holding disk which intermittently reverses its direction of rotation so as to move the sample containers back and forth in front of a plurality of radiant heating elements oriented across the ceiling of the unit. Based on the evaluation of dye liquor temperature measured within the sample container in relation to a preprogrammed set point, adjustments are made to the level of power supplied to the radiant heaters so as to alter the rate of temperature increase or decrease. Cooling air may also be introduced through a side duct. While this design has eliminated the use of high temperature liquids through the introduction of radiant heaters, an apparatus which provides such benefits while at the same time further reducing variation in treatment conditions between samples is desirable and thus provides a useful advancement over the present art.

In addition to dye sample testing, those devices described above have also been used to measure color fastness of previously dyed materials. As will be appreciated, by exposing previously dyed fabric samples to controlled temperature and detergent conditions, multiple washing cycles can be simulated. Thus, the performance of various dyed materials can be compared. However, as with sample dying evaluations, the ability to make valid comparisons is dependent upon uniformity with respect to treatment conditions.

SUMMARY OF THE INVENTION

In view of the foregoing, it is a general object of the present invention to provide a fabric sample treatment apparatus which provides Controlled treatment in a uniform manner to a plurality of fabric and dye liquor samples.

In that respect, it is an object of the present invention to provide a fabric sample treatment apparatus which simultaneously heats a plurality of fabric and dye liquor samples in a uniform manner.

It is a related object of the present invention to provide a fabric sample treatment apparatus which simultaneously heats a plurality of fabric and dye liquor samples in a uniform manner purely by use of radiation heaters.

It is a further related object of the present invention to provide a fabric sample treatment apparatus incorporating multiple cooling air inlets to improve temperature control.

It is yet a further related object of the present invention to provide a fabric sample treatment apparatus comprising a rotatably mounted sample rack including a carriage assembly and latching mechanism to prevent dislocation of individual sample containers.

Accordingly, it is a feature of the present invention to provide a fabric sample treatment apparatus which comprises radiation heating elements in combination with multidirectional cooling air inlets to effect the controlled and uniform heating of a plurality of samples.

It is a subsidiary feature of the present invention to provide a fabric sample treatment apparatus which incorporates a rotatably mounted sample rack in combination with radiation heaters and multidirectional cooling air inlets.

It is yet a further subsidiary feature of the present invention to provide a fabric sample treatment apparatus comprising a rotatable sample rack including at least one carriage assembly which is only partially openable to receive individual sample containers and including a plurality of spring biased latching assemblies for holding the carriage assemblies in a closed position, wherein the spring biased latching assemblies comprise hooked clamping members engageable with corresponding rod members by means of pivotal movement.

In accordance with the present invention, a fabric sample treatment apparatus is provided for providing controlled and uniform heating to a plurality of fabric and dye liquor specimens. The treatment apparatus comprises a heating chamber, a rotatable sample rack disposed within the heating chamber, a radiant heat source, multidirectional cooling air vents, means for measuring both the sample temperature and the heating chamber temperature and means for controlling radiant heat and cooling air based on temperature measurement of both the sample and the heating chamber.

BRIEF DESCRIPTION OF THE DRAWINGS

The foregoing and other objects, advantages and features of the present invention will become more readily apparent upon consideration of the following detailed description of the invention taken in conjunction with the accompanying drawings lo wherein.

While the invention will be described and disclosed in connection with certain preferred embodiments and procedures, it is not intended to limit the invention to those specific embodiments. Rather, it is intended to cover all such alternative embodiments and modifications as fall within the spirit and scope of the invention as defined by the appended claims.

DETAILED DESCRIPTION OF THE PREFERRED EMBODIMENT

Figure 1:
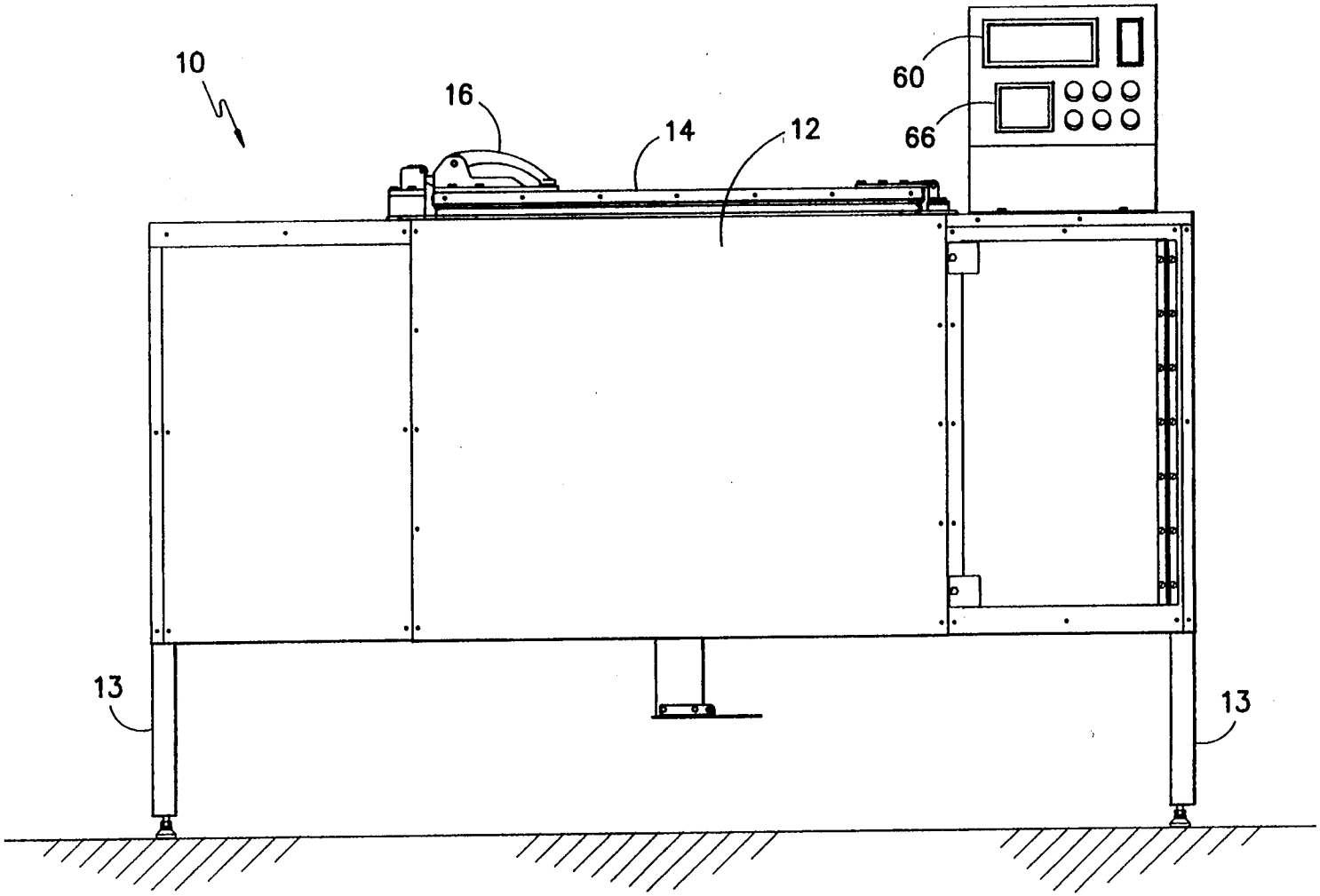
FIG. 1 is a side view of a preferred embodiment of the fabric sample treatment apparatus of the present invention.
Figure 2:
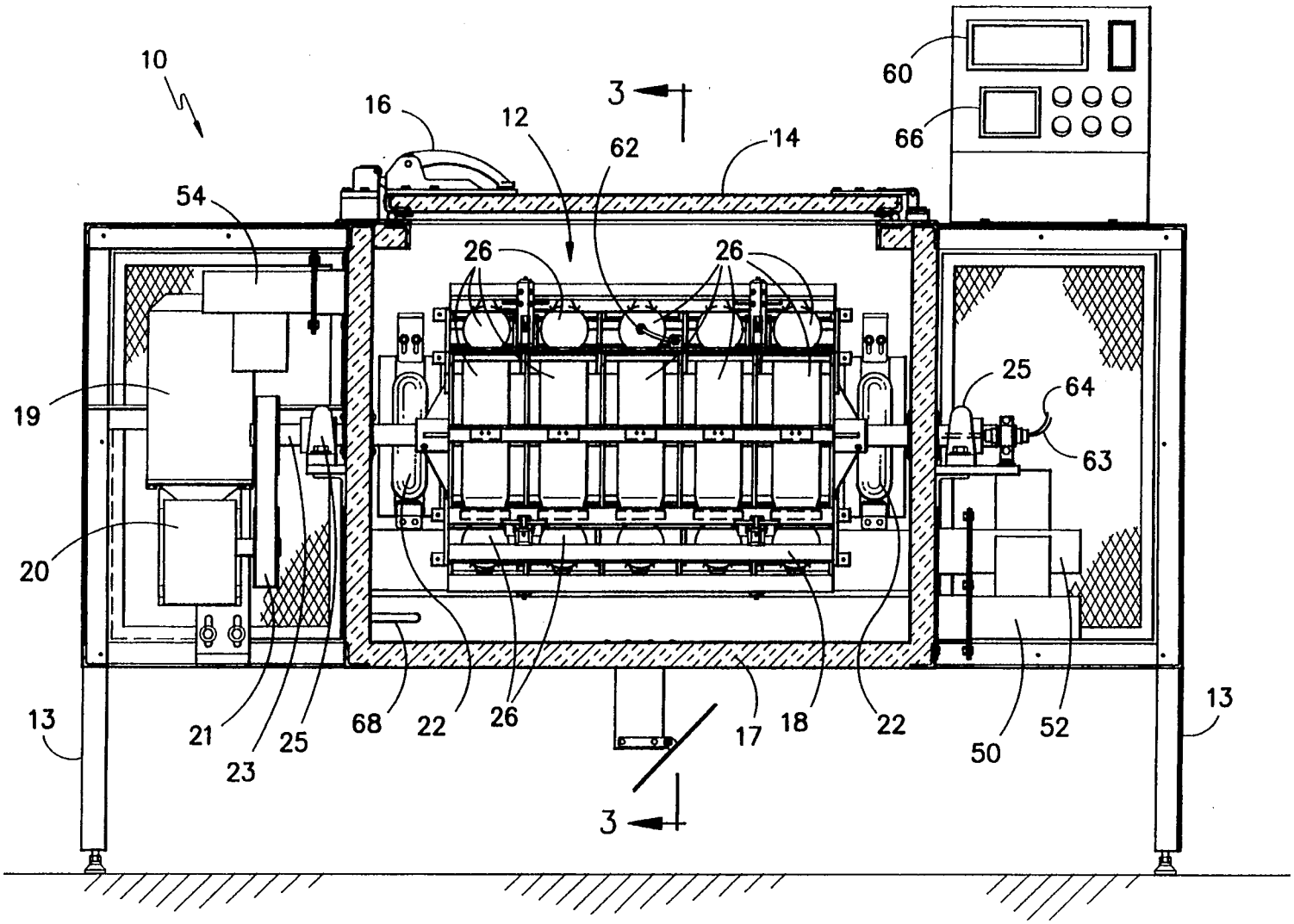
FIG. 2 is a cut away view of a preferred embodiment of the present invention as shown in FIG. 1.
Figure 3:
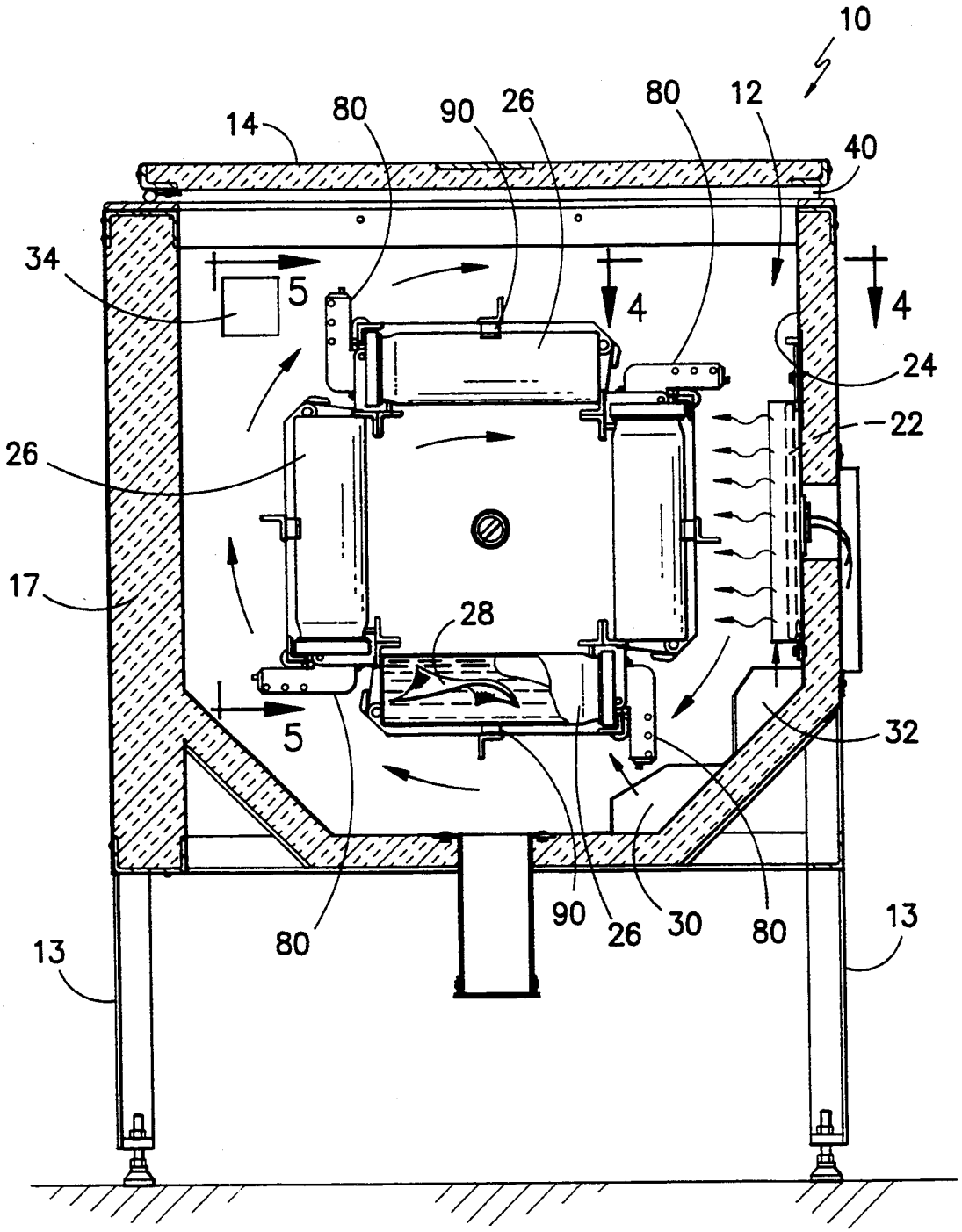
FIG. 3 is a cut away end view of a preferred embodiment of the present invention as illustrated in FIGS. 1 and 2 and taken generally along line 3—3 of FIG. 2.

Turning now to the drawings, a preferred embodiment of the fabric sample treatment apparatus 10 of the present invention is illustrated in FIGS. 1–3. As indicated above, the sample treatment apparatus of the present invention is useful in simultaneously carrying out multiple dyeing tests as well as in conducting tests relating to color fastness for previously dyed materials under washing conditions.

As illustrated in FIGS. 1 and 2, the preferred embodiment of the present invention includes a heating chamber 12 mounted on legs 13 and a displaceable hatch 14 which may be opened by means of a handle 16 thereby affording access to the interior of the heating chamber 12. The heating chamber 12 is preferably provided with insulation 17 to reduce heat loss.

Figure 4:
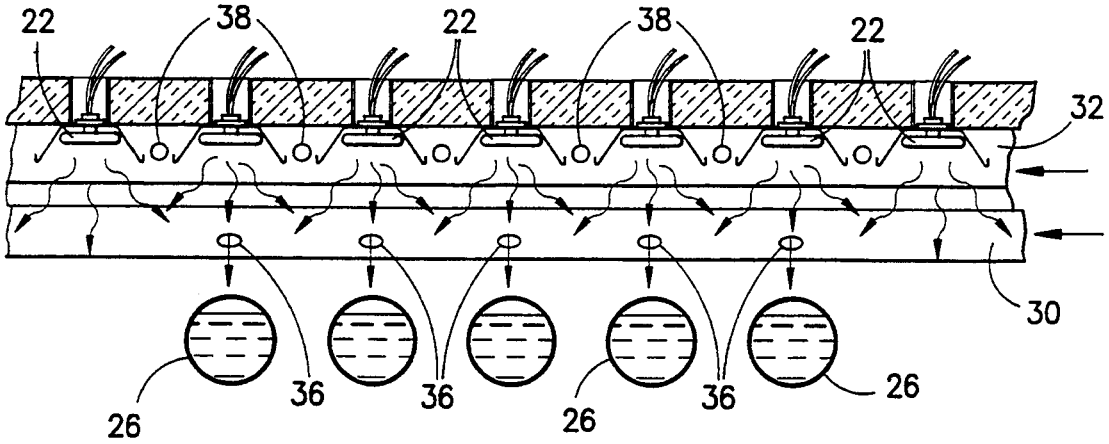
FIG. 4 is a partial top sectional view of a preferred embodiment of the present invention taken generally along line 4—4 of FIG. 3.

Disposed within the heating chamber 12 is a rotatable sample rack 18. The rotatable sample rack 18 is illustrated in side view in FIGS. 2 and 5 and in end view in FIGS. 3 and 6. As illustrated, the sample rack 18 may be rotated by means of a motor 19 acting through a gear box 20 and a power transfer mechanism 21 such as a belt drive, chain drive, intermeshing gears and the like to cause rotation of a centrally disposed drive shaft 23 housed in bearings 25 (FIG. 2). Also contained within heating chamber 12 are a plurality of radiant heating elements 22. One such heating element which has been found to be acceptable is the OGDEN model A-1-1000 manufactured by OGDEN Inc. in Arlington Heights, Ill. and believed to be available from J.M.S. Southeast Inc. located in Statesville, N.C. As illustrated in FIGS. 3 and 4, each of the radiant heating elements 22 will preferably be substantially identical in configuration and will preferably be disposed against the rear wall 24 of the heating chamber 12. The configuration and orientation of the radiant heating elements 22 should be such as to provide sample containers 26 housed within sample rack 18 with uniform radiant heating. The preferred orientation of the heating elements 22 in relation to the individual sample containers 26 is illustrated in FIG. 4. As shown, the sample containers 26 are typically of a generally cylindrical nature and are capable of sealing a swatch of fabric 28 in a liquid dye or detergent solution without spillage (FIG. 3).

In an important aspect of the present invention, a first air duct 30, a second air duct 32, and a third air duct 34 are provided to deliver cooling air to the heating chamber 12. As best illustrated by reference to FIGS. 3 and 4, the first air duct 30 is provided with a plurality of ventilation openings 36 disposed along the length thereof. The ventilation openings 36 in the first air duct 30 are preferably oriented immediately adjacent to the rotational path of the individual sample containers 26 as illustrated in FIG. 4. Preferably, the ventilation openings 36 in the first air duct 30 are oriented at an upward angle generally towards the center of the heating chamber to direct air flow as illustrated by the directional arrow in FIG. 3, thereby providing effective convective cooling to the individual sample containers 26 over a broad section of their rotational path.

The second air duct 32 incorporates a second series of ventilation openings 38 (FIG. 4). The ventilation openings 38 incorporated in the second air duct 32 are preferably disposed between the individual radiant heating elements 22. In the preferred embodiment, the ventilation openings 38 of the second air duct 32 are oriented so as to direct flow upwardly between the radiant heating elements 22, thereby forcing heat out of the heating chamber 12 at the intersection 40 between the displaceable hatch 14 and the rear wall 24 of the heating chamber 12 (FIG. 3) while avoiding substantial convective cooling of the individual sample containers 26.

As previously indicated, the preferred embodiment of the present invention also incorporates a third air duct 34. As shown, the third air duct 34 has a single opening which directs air directly into the heating chamber 12, thereby providing a rapid introduction of cooling air when activated.

As illustrated in FIG. 2, each of the air ducts 30, 32, and 34 is preferably connected to an electrically powered ventilation fan 50, 52 and 54 respectively, for feeding air through the air ducts to the vent openings. As will be appreciated, the ventilation air may be driven by means other than fans such as, for example, blowers or the like. The term fan as used herein is thus meant to cover all such devices as are well known to those of skill in the art. While various means may be used for driving the ventilation air through the air ducts 30, 32, 34, it has been found that fan Model No. 2E915A available from the Grainger Division of W. W. Grainger Inc. having a place of business in Spartanburg S.C. serves to provide adequate cooling air to supply each of the air ducts 30, 32, 34. Thus, in the preferred embodiment of the present invention three such units may be utilized as illustrated.

In the illustrated and preferred embodiment, the operation of the motor 19, the radiant heating elements 22, the ventilation fan 50 feeding the first air duct 30 the ventilation fan 52 feeding the second air duct 32 and the ventilation fan 54 feeding the third air duct 34 can all be controlled by means of a first programmable controller 60. One such controller is the PC 1001 available from Select Controls Incorporated located in Charlotte N.C.

The first programmable controller 60 preferably utilizes a series of pre-programmed temperature set points which are compared to actual measured temperatures within one of the individual sample containers 26 to regulate the power to the radiant heating elements 22 and to the ventilation fan 50 feeding the first air duct 30 so as to provide a controlled temperature rise within the individual sample containers 26. In the illustrated and preferred embodiment, a sample temperature probe 62 comprising a first temperature sensing element and a second temperature sensing element is inserted into one of the sample containers 26 housed in the sample rack 18. The first and second temperature sensing elements may be RTD elements, thermocouples or the like as are well known to those of skill in the art. RTD elements may be preferred.

In operation, the first temperature sensing element provides a signal to the first programmable controller 60 by means of a first wire bundle 63. If the temperature measured by the first temperature sensing element is below the setpoint of the first programmable controller 60, the power delivered to the radiant heating elements is increased to increase the temperature within the individual sample containers 26. Conversely, if the temperature measured by the first temperature sensing element is greater than the setpoint of the first programmable controller 60, the power to the radiant heating elements 22 is decreased and the ventilation fan 50, feeding the first air duct 30, is activated to deliver cooling air to the sample containers 26 as described above.

The first programmable controller 60 is preferably capable of activating all three ventilation fans 50, 52, and 54 at the conclusion of the testing cycle. Thus, when the cycle is completed as indicated by a preset internal timer, the heating chamber 12 can be flooded with large volumes of cooling air from all three air ducts 30, 32, and 34, thereby permitting the individual sample containers to be removed after only a short period of time.

The second temperature sensing element in the sample temperature probe 62 housed within one of the sample containers 26 transmits temperature data via a second wire bundle 64 to a second programmable controller 66 which is set to override the first programmable controller 60 and to cut all power to the radiant heating elements 22 if a preprogrammed high temperature limit is reached within the sample container. One such second programmable controller is the Model 2040 manufactured by L.F.E. Instruments Division located in Chesterland Ohio. Thus, the second temperature controller 66 functions as a safety to prevent the samples from over heating in the event that the first programmable controller 60 fails.

The apparatus of the present invention also preferably includes a chamber temperature probe 68 which includes a temperature sensing element such as an RTD, a thermocouple, or the like to measure the temperature within the heating chamber 12. The chamber temperature probe 68 sends temperature signals to a third programmable controller (not shown) such as an OMRON Model E5CS-X. During operation, if the temperature measured within the heating chamber 12 exceeds a preset limit, the third programmable controller activates the ventilation fan 52 supplying cooling air to the second air duct 32 so as to deliver cooling air upward between the radiant heating elements 22, thereby forcing heat out of the heating chamber 12 as described above.

In the preferred embodiment, the third programmable controller is independent from the first and second programmable controllers and thereby provides an additional level of safety against over heating.

At the beginning of a typical heating cycle, the first programmable controller 60 is programmed with a desired set point temperature for the sample as well as the desired cycle time. The second programmable controller 66 is programmed with a high temperature limit for the sample. The third programmable controller is programmed with a high temperature limit for the heating chamber. Typical target set point temperatures for the sample may be in the range of 212 degrees Fahrenheit to 280 degrees Fahrenheit with a high temperature limit of 290 degrees Fahrenheit, while a typical high temperature limit for the heating chamber 12 may be in the range of approximately 300 degrees Fahrenheit. As will be recognized, alternative temperature set points may be utilized if desired.

Since the typical sample temperature set point is greater than room temperature, the radiant heating elements 22 will be activated upon commencement of the cycle as the first programmable controller 60 seeks to bring the temperature within the sample container into accord with the corresponding set point. As power is supplied to the radiant heaters 22, the temperature of the samples is increased as they are rotated past the energized radiant heaters 22 by means of the motor 19. As will be appreciated, the operation of the radiant heaters 22 also tends to increase the temperature within the heating chamber 12. As previously indicated, the temperature within the heating chamber 12 is monitored by means of the chamber temperature probe 68.

It has been found that upon initial heat up, the temperature within the heating chamber 12 tends to exceed the temperature within the sample containers 26. This variation in temperature is thought to be due to the differences in heat transfer mechanisms acting on the closed, liquid filled sample containers 26 and the relatively open heating chamber 12. This difference is also believed to permit the heating chamber 12 to be cooled more readily than the samples. Thus, during the initial heating stage, the temperature rise within the heating chamber 12 will typically lead the temperature rise within the sample containers. In the event that the temperature measured within the sample chamber 12 exceeds the predetermined set point, the ventilation fan 52 is activated, thereby forcing cooling air through the second air duct 32 and outwardly through the corresponding ventilation openings 38 (FIGS. 3, 4). It has been found that this cooling air tends to diminish the temperature within the heating chamber 12 relatively quickly without significantly altering the temperature within the sample containers 26.

With respect to the sample temperature, as the set point is approached, the power to the radiant heaters 22 can be reduced so as to coast the temperature of the samples up to the desired point. Moreover, if the sample temperature set point is exceeded, the first programmable controller 60 activates the ventilation fan 50 connected to the first air duct 30 to initiate air flow through the corresponding ventilation openings 36. As indicated previously, the ventilation openings 38 are disposed substantially adjacent to the path of the individual sample containers 26. It is to be appreciated that by intermittently activating the ventilation fan 50 and simultaneously adjusting the power supplied to the radiant heaters 22 based on feedback data from the sample temperature probe 62, the temperature within the individual sample containers 26 can be maintained within a fairly narrow range. Finally, when the preset time for the cycle is complete, the first programmable controller activates all three ventilation fans 50, 52 and 54 to rapidly cool the heating chamber.

Figure 6:
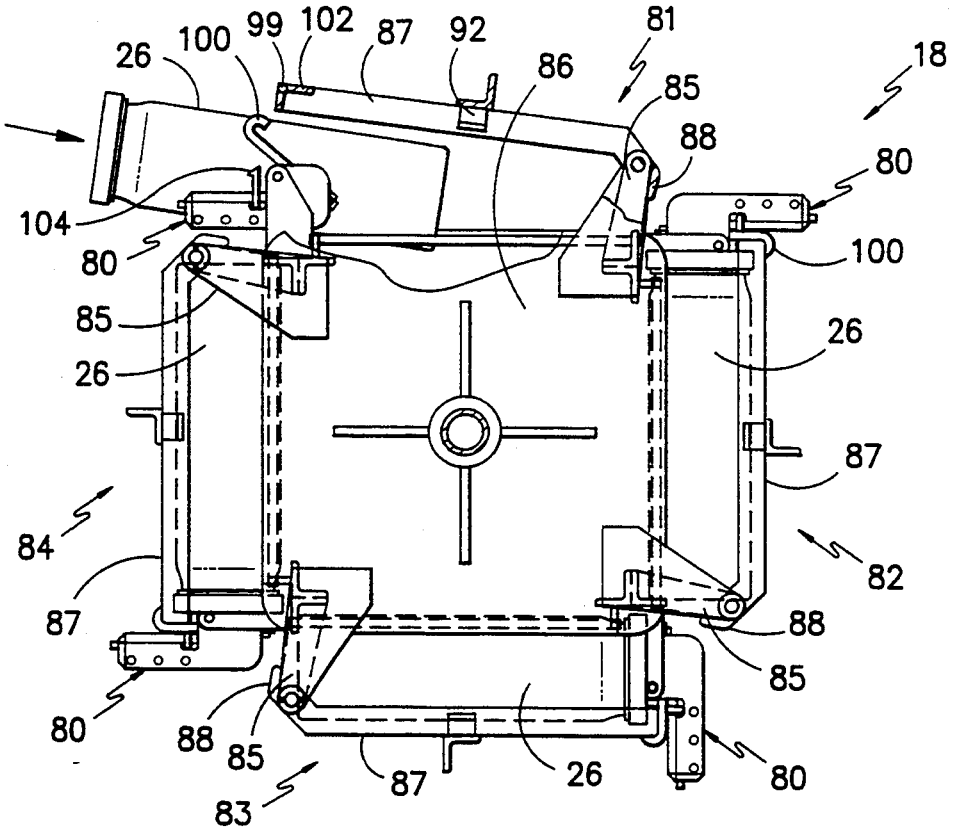
FIG. 6 is an end view of a preferred embodiment of a partially filled sample rack for use in the present invention taken generally along line 6—6 of FIG. 5 and illustrating the loading of a sample container.

In accordance with a further aspect of the present invention, an improved sample rack 18 utilizing a cage-like structure and a spring bias latching assembly 80 for use in the fabric sample treatment apparatus 10 are also provided. As illustrated in FIG. 6, the sample rack 18 for use in the present invention is adapted to house a multiplicity of sample containers 26. Specifically, in a preferred embodiment, the sample rack is capable of holding twenty individual sample containers on four different planar carriage assemblies 81, 82, 83, 84. As illustrated, each of the substantially identical carriage assemblies 81, 82, 83, 84 may be adjustable between an open and closed position (FIG. 6) and includes a first arm 85 mounted to the frame 86 of the rotatable sample rack 18. Each of the carriage assemblies also preferably includes a second arm 87 which is partially rotatable with respect to the first arm 85, thereby making the carriage assemblies only partially openable. Full rotation is prevented by means of a blocking bevel 88 which contacts the first arm 85 of the carriage assembly when the second arm 87 is raised. As illustrated, this partial rotation permits the insertion of sample containers 26 when the carriage assemblies 81, 82, 83, 84 are in the open position. As will be appreciated, allowing only partial opening of the carriage assemblies serves to provide protection against the individual sample containers 26 becoming dislodged during rotation of the sample rack 18 and doing damage to the radiant heaters 22 even if the containers are not locked in place in the manner described below.

Figure 7:
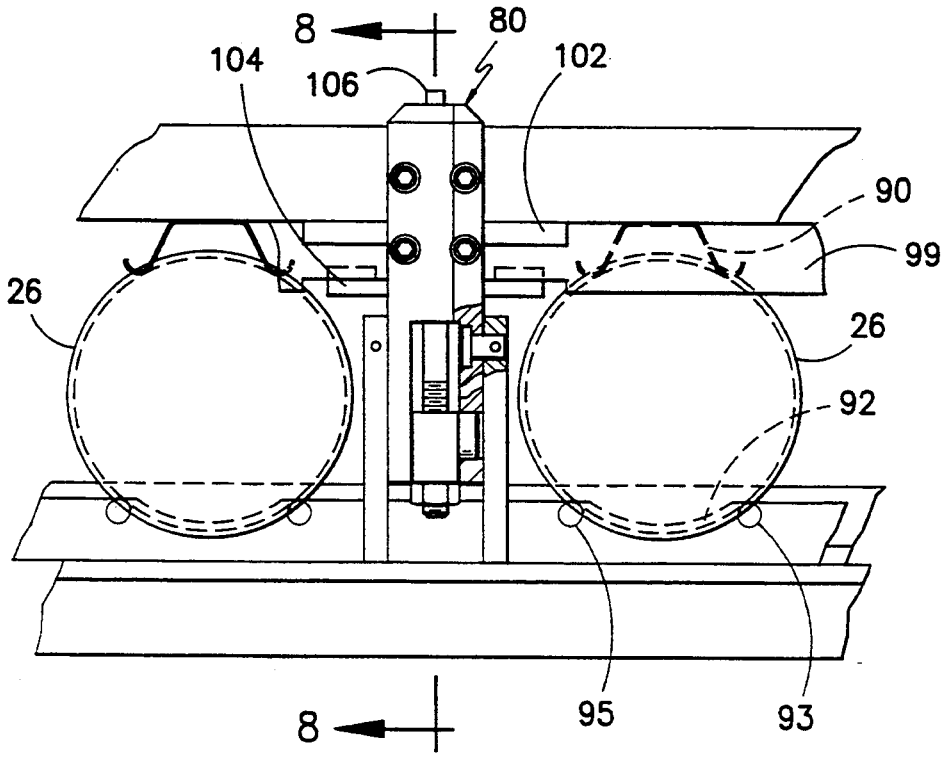
FIG. 7 is a frontal view of a preferred embodiment of clamping mechanism for use in securing containers within the sample rack illustrated in FIGS. 5 and 6.

In the preferred embodiment, the prevention against the sample containers 26 becoming dislodged during rotation is further enhanced by the use of a leaf spring 90 in combination with an opposing cradle depression 92 formed by two adjacent cradle rods 93, 95 (FIG. 7). As Illustrated, a sample container 26 housed within the preferred embodiment of the present invention is cradled between the two adjacent cradle rods 93, 95 and is held in place by the opposing leaf spring 90.

Figure 5:
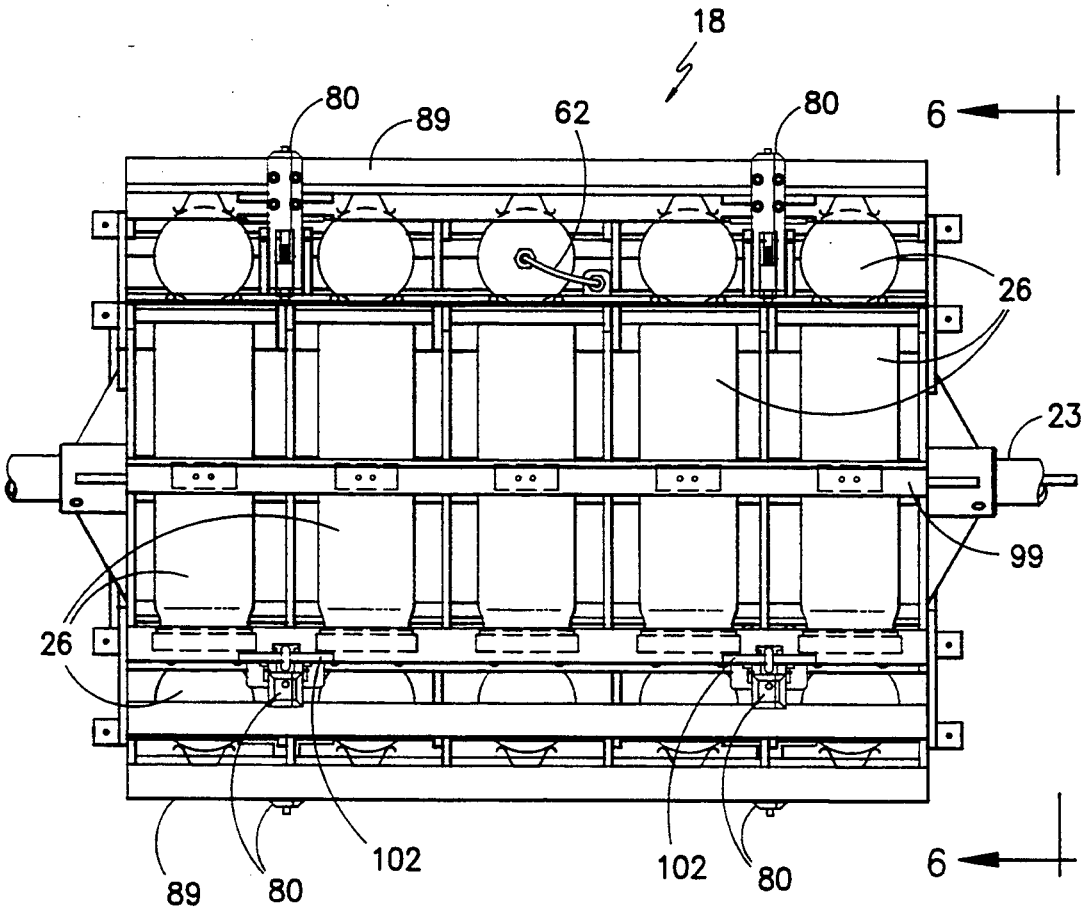
FIG. 5 is a side view of a preferred embodiment of a filled sample rack for use in the present invention taken generally along line 5—5 of FIG. 3.

In the preferred embodiment, the carriage assemblies 81, 82, 83, 84 extend substantially the length of the rotatable sample rack 18 with connection between the ends thereof being effected by means of a cross bar 99 as illustrated in FIGS. 5 and 7.

Figure 8A:
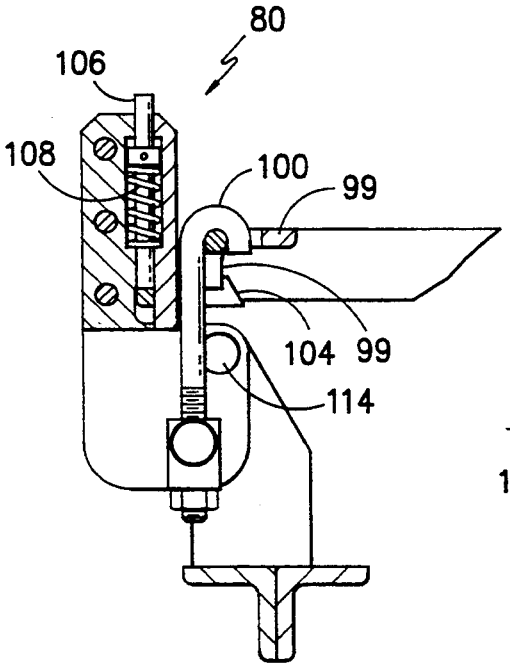
FIG. 8A is a partially cut away side view of the preferred embodiment of clamping mechanism taken generally along line 8—8 of FIG. 7 illustrating the clamping mechanism in a locked and closed position.
Figure 8B:
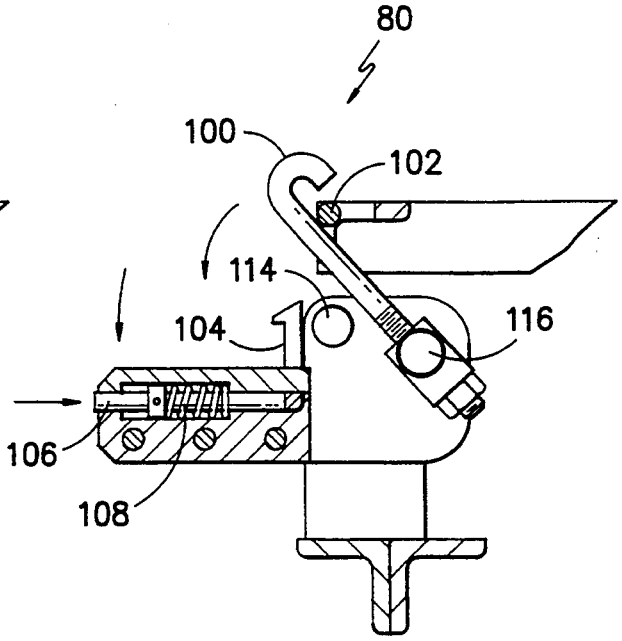
FIG. 8B is a partially cut away side view of the preferred embodiment of clamping mechanism taken along line 8—8 of FIG. 7 illustrating the clamping mechanism in an unlocked and open position.

During operation, the carriage assemblies 81, 82, 83, 84 are preferably each secured in a closed position by means of at least one rotatable spring bias latching assembly 80. As illustrated in FIG. 5, in the preferred embodiment, two latching assemblies 80 are utilized along the length of the cross bar 99 of each carriage assembly. This securement in a closed position is effected by means of mating engagement between a J-hook clamping member 100 and a corresponding rod member 102 (FIG. 8B). The rod member 102 may be attached to the cross bar 99 by any conventional and convenient means such as by welding or the like.

In the preferred embodiment, the rotatable spring biased latching assembly 80 includes a beveled hasp member 104 operably connected to a biased pin member 106 (FIGS. 6, 8A) which is in integral contact with an internal spring member 108. As illustrated in FIG. 8A, in the closed position, the beveled hasp member 104 is held in place in locking relation with the cross bar 99 by means of the outward bias produced through the compression of spring member 108. This, in turn, causes the J-hook clamping member 100 to remain fastened over the corresponding rod member 102 thereby providing the primary locking engagement.

The locking structure may be released as illustrated in FIG. 8B through the application of pressure to the biased pin member 106, thereby overcoming the force of spring member 108. This depression of the biased pin member 106 in turn permits the beveled hasp member 104 to swing free of its abutting relation with the cross bar 99. The entire latching assembly 80 can thereafter be pivoted about a first pivot member 114. This rotation about the first pivot member 114 likewise forces the J-hook clamping member 100 upwards and away from the rod member 102 thereby permitting the J-hook clamping member 100 to be rotated away from the clamping position about a second pivot member 116.

What is claimed is:

1. A fabric sample treatment apparatus comprising:

a heating chamber;

a rotatable sample rack for holding sample containers disposed within said heating chamber wherein said rotatable sample rack includes a carriage assembly, said carriage assembly being adjustable between open and closed positions and said carriage assembly including mating cradles and leaf springs for maintaining said sample containers in place when said carriage assembly is in the closed position;

a plurality of radiant heating elements disposed adjacent to said rotatable sample rack within said heating chamber;

a plurality of fans for introducing air into said heating chamber through a plurality of ventilation openings disposed within said heating chamber;

a motor for rotating said rotatable sample rack; and control means for controlling said plurality of radiant heating elements and said plurality of fans, such that the temperature within said heating chamber may be controlled.

2. The apparatus of claim 1, further comprising temperature sensors for sensing the temperature within said sample containers.

3. The apparatus of claim 2, further comprising a temperature sensor for sensing the temperature within said heating chamber.

4. A fabric sample treatment apparatus, comprising:

an enclosed heating chamber;

means for supporting said heating chamber;

a rotatable sample rack disposed within said heating chamber, said rotatable sample rack including a plurality of carriage assemblies for holding a plurality of sample containers, said carriage assemblies being adjustable between open and closed positions, said rotatable sample rack further including spring biased latching assemblies for maintaining said carriage assemblies in the closed position during rotation;

a plurality of electrically powered radiant heating elements disposed adjacent to said rotatable sample rack;

a first air duct having openings directed towards said rotatable sample rack;

a second air duct having openings directed between said radiant heating elements;

electrically powered fans for conveying air to said first and second air ducts;

means for measuring the temperature within said heating chamber and said sample containers; and means for controlling power supplied to said electrically powered radiant heating elements and to said electrically powered fans based on the temperature measured within said heating chamber and said sample containers.

5. The apparatus of claim 4, wherein said spring biased latching assemblies comprise hooked clamping members and corresponding rod members to engage said hooked clamping members when said hooked clamping members are pivoted into engagement with said corresponding rod members.

6. A fabric sample treatment apparatus, comprising:

a heating chamber, said heating chamber including a walled interior;

means for supporting said heating chamber;

a rotatable sample rack disposed within said heating chamber, said rotatable sample rack having the capacity to hold a plurality of sample containers;

a plurality of radiant heating elements disposed against one wall of said walled interior of said heating chamber;

a first air duct comprising a plurality of vent openings disposed adjacent to said plurality of sample containers;

first fan means for conveying cooling air through said first air duct;

a second air duct including a plurality of vent openings disposed between said radiant heating elements;

second fan means for conveying cooling air through said second air duct;

at least a third air duct for introducing large quantities of cooling air to said heating chamber to cool said heating chamber at the conclusion of operation;

first temperature sensing means for sensing the temperature within at least one of said plurality of sample containers;

second temperature sensing means for sensing the temperature within said heating chamber;

first control means for controlling said radiant heating elements and said first fan means based on the temperature sensed by said first temperature sensing means such that the temperature within said plurality of sample containers is controlled;

second control means for controlling said radiant heating elements in the event said first control means fail; and third control means for controlling said second fan means based on the temperature sensed by said second temperature sensing means.

* * * * *